United States Patent [19]

Ristvedt

[11] Patent Number: 4,765,464

[45] **Date of Patent: * Aug. 23, 1988**

[54] WRAPPED COIN ROLL AND METHOD OF FORMING SAME

[75] Inventor: Victor G. Ristvedt, Manchester, Tenn.

[73] Assignee: Ristvedt-Johnson, Inc., Mt. Prospect, Ill.

[ * ] Notice: The portion of the term of this patent subsequent to Oct. 15, 2002 has been disclaimed.

[21] Appl. No.: 908,950

[22] Filed: Sep. 16, 1986

Related U.S. Application Data

[63] Continuation of Ser. No. 785,342, Oct. 7, 1985, abandoned.

[51] Int. Cl.[4] ..... B65D 65/00; B65D 85/62

[52] U.S. Cl. ..... 206/0.82; 53/213; 53/214; 53/447; 53/465; 206/445; 206/460; 229/87.2

[58] Field of Search ..... 53/212–214, 53/445, 447, 465; 133/1 A; 206/0.8, 0.81, 0.82, 0.83, 445, 460, 813; 229/87 R, 87.2

[56] References Cited

U.S. PATENT DOCUMENTS

| | | | |
|---|---|---|---|
| 1,037,218 | 9/1912 | Dirnberger | 229/87.2 |
| 2,008,167 | 7/1935 | Bergstein | 229/87 R |
| 2,260,150 | 10/1941 | Millard | 229/87.2 |
| 2,371,985 | 3/1945 | Freiberg | 53/465 |
| 2,883,045 | 4/1959 | Abramson | 229/87 R |
| 3,047,144 | 7/1962 | Wissel | 206/0.83 |
| 3,533,501 | 10/1970 | Dorsett | 206/0.82 |
| 4,199,911 | 4/1980 | Miyazaki et al. | 53/212 |
| 4,384,644 | 5/1983 | Uchida | 206/0.8 |
| 4,546,875 | 10/1985 | Zweber | 206/0.82 |

*Primary Examiner*—Jimmy G. Foster

*Attorney, Agent, or Firm*—Stephen G. Rudisill

[57] ABSTRACT

A wrapped roll of coins in which the wrapper comprises a flexible substrate. The wrapper has pressure sensitive adhesive on its inner surface which can be selectively cleanly released from the coins. And a process for applying and removing the wrapper.

6 Claims, 4 Drawing Sheets

WRAPPED COIN ROLL AND METHOD OF FORMING SAME

This is a continuation of co-pending application Ser. No. 785,342 filed on Oct. 7, 1985, now abandoned.

FIELD OF THE INVENTION

The present invention relates generally to wrapped coin rolls and methods of forming the same.

SUMMARY OF THE INVENTION

It is a primary object of the present invention to provide a wrapped coin roll which can be easily formed without the use of complex guiding mechanisms to control the wrapping material during the coin-wrapping operation.

Another important object is to provide an improved wrapped coin roll which does not require crimping of the wrapping material at the ends of the coin roll.

Still another object of this invention is to provide an improved wrapped coin roll which can be easily opened.

Other objects and advantages of the invention will be apparent from the following detailed description and the accompanying drawings.

In accordance with the present invention, the foregoing objects are realized by a wrapped roll of coins comprising a roll of coins having a length and a circumference; and a wrapper comprising (1) a flexible substrate having a substrate length and a substrate width, the substrate width being greater than the circumference of the roll, and the substrate length being at least as great as the length of the roll; along the length of the substrate an inside edge which contacts the length of the roll and, at the opposite end of the substrate, an outside edge; along the width of the substrate a pair of side edges, an inner surface which faces radially toward the roll; and an outer surface which faces radially away from the roll; and (ii) on the inner surface of the flexible substrate proximate the side edges, a coin-supporting amount of an effective clean-releasing pressure-sensitive adhesive, wherein the adhesive securely retains the coins within the wrapper and the coins can be selectively cleanly released from the wrapper without tearing the wrapper, whereby the wrapper can be reused. There is also provided a method for selectively holding a roll of coins having a circumference, a length, two ends and two opposite circular sides, comprising the steps of arranging coins to form the roll of coins; selecting a flexible substrate having a substrate length and a substrate width, the substrate width being greater than the circumference of the roll, and the substrate length being at least as great as the length of the roll; along the length of the substrate an inside edge which is suitable for contacting the length of the roll and, at the opposite end of the substrate, an outside edge; along the width of the substrate a pair of side edges; an inner surface suitable for contacting the roll of coins; and an outer surface opposite the inner surface, wherein on the inner surface proximate the side edges is a coin-supporting amount of an effective clean-releasing pressure-sensitive adhesive; (c) contacting the length of the roll with the inside edge of the flexible substrate such that the ends of the coin roll are in contact with the adhesive; (d) wrapping the roll in the flexible substrate, wherein the inner surface of the flexible substrate is in operable contact with the coins around the circumference of the roll of coins and wherein the ends of coin roll are securely retained by the adhesive; and (e) removing the flexible substrate to unwrap the roll, wherein the roll of coins is cleanly released and wherein the flexible substrate can be reused.

DEATILED DESCRIPTION OF PREFERRED EMBODIMENTS

Figure 1:
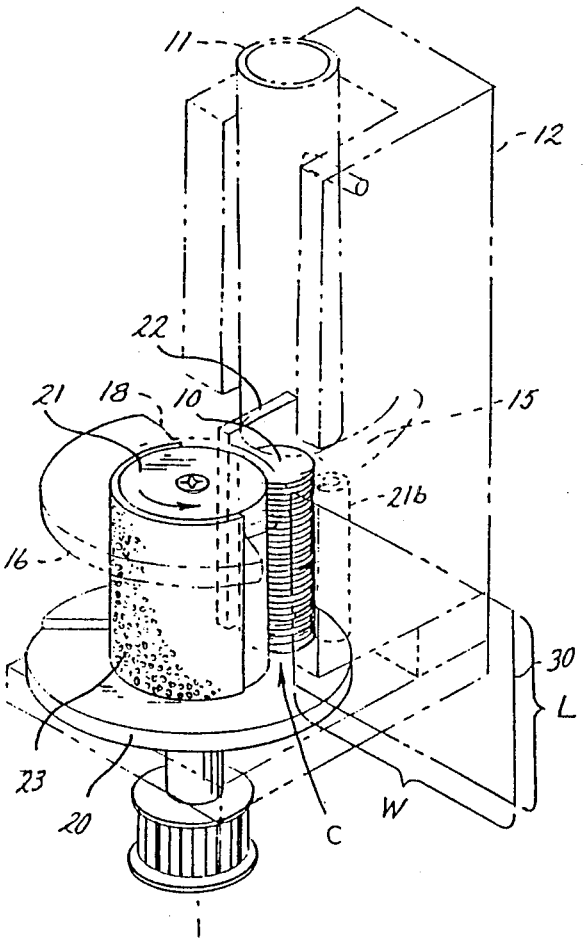
FIG. 1 is a perspective view of a coin wrapping mechanism, in a first stage of its operation, for forming a coin roll embodying the present invention.

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents, and alternatives falling within the spirit and scope of the invention as defined by the appended claims.

Figure 2:
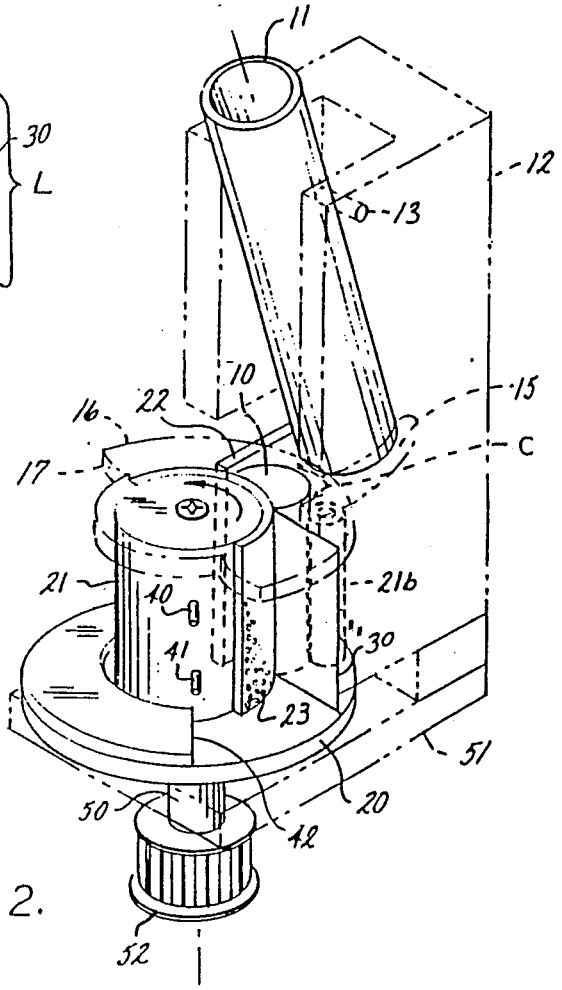
FIG. 2 is a perspective view of the coin wrapping mechanism of FIG. 1 in a second stage of its operation.
Figure 3:
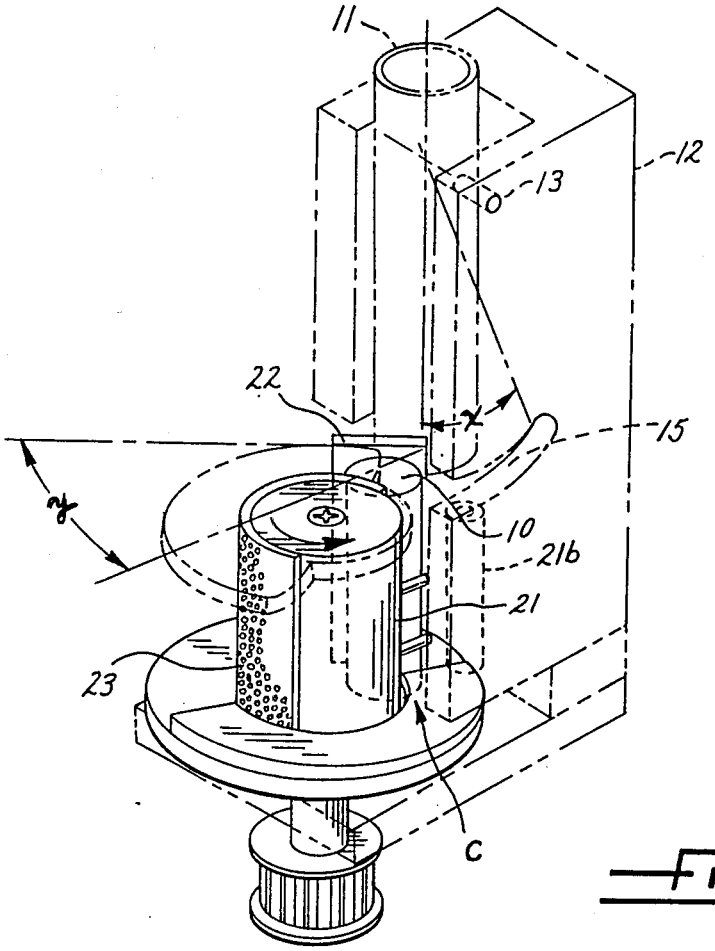
FIG. 3 is a perspective view of the coin wrapping mechanism of FIG. 1 in a third stage of its operation.
Figure 4:
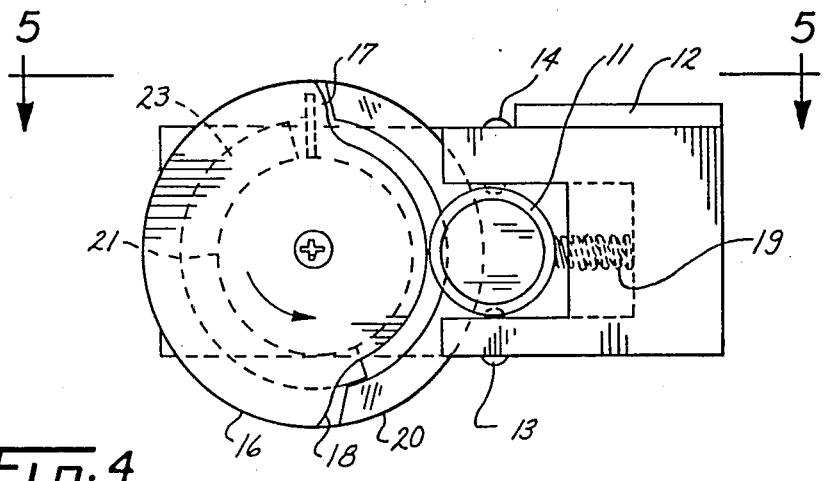
FIG. 4 is a top plan view of the coin wrapping mechanism of FIG. 1.
Figure 5:
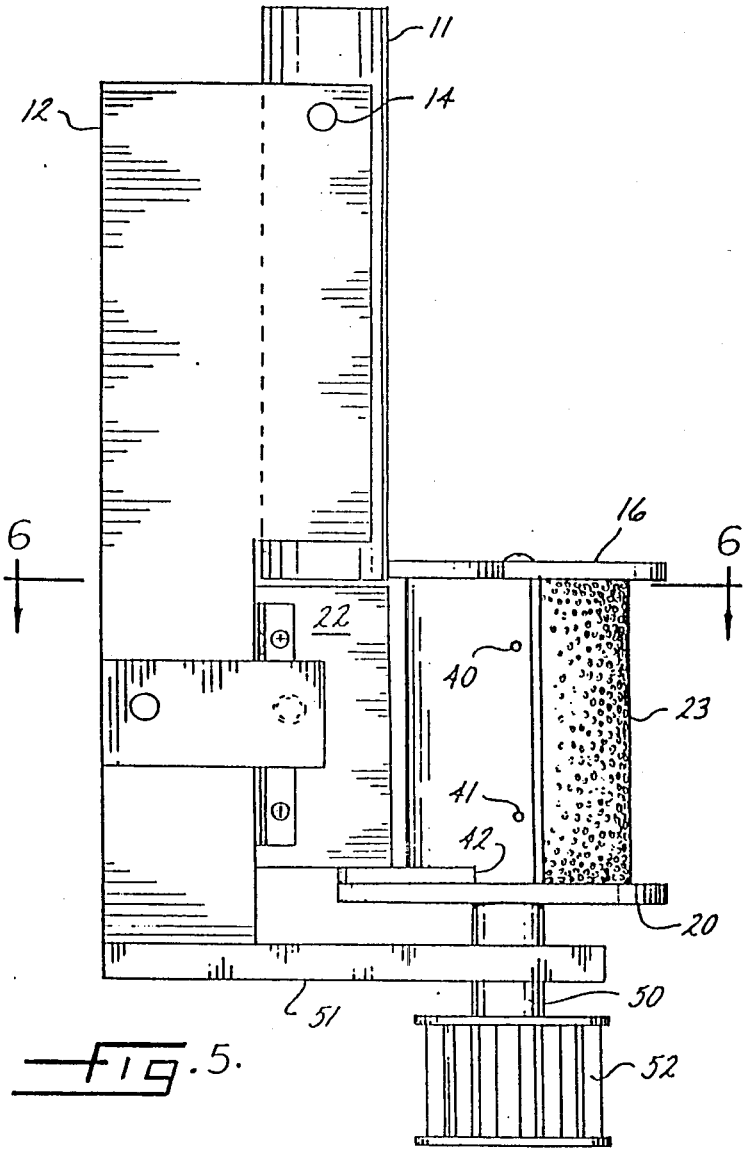
FIG. 5 is a side elevation taken generally along line 5—5 in FIG. 4.
Figure 6:
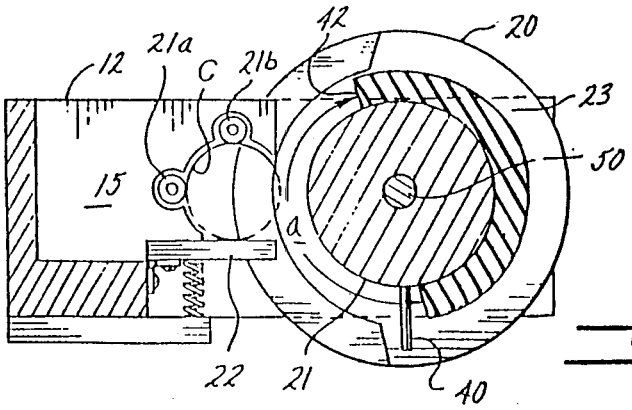
FIG. 6 is a section taken generally along line 6—6 in FIG. 5.

Turning now to the drawings, FIGS. 1, 2 and 3 illustrate a coin roll wrapping mechanism in three successive stages of operation. Referring first to FIG. 1, a coin stack 10 having a known length and circumference (with two ends and two opposite circular sides) is loaded from a buffer tube 11 into a wrapping chamber C formed by a housing 12. The buffer tube 11 is pivotally supported in the upper portion of the housing 12 by a pair of diametrically opposed pins 13 and 14 fitting into recesses in the outside wall of the tube 11, so that the lower end of the tube can be pivoted through the angle X between (1) a "load buffer" position (illustrated in FIGS. 1 and 2) where the bottom of the tube is blocked by a shoulder 15 formed by the housing 12 directly above and adjacent to the wrapping chamber C, and (2) a "load wrapper" position (illustrated in FIG. 3) where the bottom of the tube 11 opens directly into the wrapping chamber C. In the "load buffer" position, the tube 11 receives a pre-counted stack of coins in readiness for the next wrapping operation. In the "load wrapper" position, the stack of coins accumulated in the buffer tube 11 is dropped into the wrapping chamber C, ready to be wrapped.

The coin stack 10, which contains a prescribed number of coins of a given denomination, may be formed by any of a variety of different coin counting and stacking mechanisms, such as the one described in Nakamura et al. U.S. Pat. No. 4,515,172. Such stacking mechanisms typically have a shutter which opens each time it is desired to load a new coin stack into the wrapping mechanism. When the shutter opens, the coin stack 10 drops into the buffer tube 11. Alternatively, the desired number of coins can be loaded into the buffer tube 11 by hand.

In order to pivot the buffer tube 11 to its retracted or "load buffer" position after the coins in the buffer tube have been dropped into the wrapping chamber C, a rotatable cam 16 with a smoothly rounded leading edge 17 engages the outside wall of the tube 11 near the lower end thereof and pushes the lower end of the tube to its retracted position (as shown in FIGS. 1 and 2). The outer edge of the cam 16 then maintains the tube 11 in its retracted position throughout the wrapping of the coin stack in the wrapping chamber. When the trailing edge 18 of the cam 16 clears the tube 11, a spring 19 pivots the tube to its advanced or "load buffer" position (illustrated in FIG. 3). The relationship of the rotational movement of the cam 16 and the wrapping mechanism will be apparent from the ensuing description.

The stack of coins loaded into the wrapping chamber C rests on a disc 20 extending radially outwardly from the bottom of a wrapping roller 21 adjacent the wrapping chamber. Lateral support for the coin stack 10 is provided by a pair of idler rollers 21*a* and 21*b* recessed in the walls of the wrapping chamber C, a spring-loaded exit gate 22, and the wrapping roller 21. The coin stack 10 is free to rotate about its longitudinal axis while supported in this manner within the wrapping chamber. The cam 16 is mounted on the top of the wrapping roller 21, which extends slightly above the top of the coin stack 10.

A sheet of wrapping material 30, such as a plastic film or paper, is fed between the coin stack 10 and the wrapping roller 21, either manually or by an automatic sheet feeder. This sheet of wrapping material 30 forms a flexible substrate having a width W greater than the circumference of the roll and a length L at least as great as the length of the roll. One side of this wrapping material 30, namely the side facing the coin stack 10, is coated with a pressure-sensitive, releasable adhesive 31, such as No. 4351 film tape available from Can-Do Inc., Nashville, Tenn. Other suitable adhesives are those disclosed in U.S. Pat. No. 4,418,120 as having good tack and shear properties but low peel adhesion to stainless steel. That is, the adhesive should adhere quickly to the outer surface of a stack of coins and have sufficient shear strength to securely retain the coins within the wrapper during handling, and yet have a peel adhesion low enough to be effectively clean-releasing, permitting the wrapping material to be readily peeled off the coin roll without leaving any substantial residue of adhesive on the coins and without tearing the wrapping material. If desired, the wrapper can be re-used. The adhesive coating 31 is preferably continuous along the full length and across the full width of the material 30.

In order to press the wrapping material 30 against the coin stack 10, while simultaneously rotating the coin stack, a resilient rubber or foamed-polymer pad 23 is bonded to the outer surface of the wrapping roller 21. It will be noted that the resilient pad 23 does not extend all the way around the circumference of the wrapping roller 21, thereby forming an "open" angle a within which a new sheet of wrapping material 30 can be inserted into the throat between the roller 21 and the coin stack 10 in each revolution of the roller. Then when the leading edge of the resilient pad 23 engages the new sheet of wrapping material, the pad 23 presses the leading edge 32 of the wrapping material 30 against the coin stack. Because of the adhesive coating on the side of the wrapping material 30 facing the coin stack, the wrapping material adheres to the coin stack.

Continued rotation of the roller 21 and the pad 23 causes the coin stack to rotate because the resilient pad 23 continues to press against the coin stack, through the wrapping material 30. As the coin stack is rotated, the sheet of wrapping material 30 follows the rotating surface of the stack, both because the wrapping material is adhered to the surface of the stack and because the wrapping material is drawn into the nip between the roller 21 and the coin stack 10, and continues to be pressed against the coin stack, by the resilient pad 23. Thus, the wrapping material is wound tightly around the coin stack 10 as the stack is driven by the pad 23.

In the illustrative embodiment, the circumferential length of the pad 23 is only slightly longer than the circumference of the coin stack, so that only one layer of the wrapping material is wound around the major portion of the stack with only the trailing edge 33 of the wrapping material overlapping and adhered to the first layer of wrapping material. It will be recognized, however, that the diameter of the roller 21 and/or the circumferential length of the pad 23 can be increased to wrap two or more layers of wrapping material around the stack of coins. If desired, the pad 23 can extend around the entire circumference of the roller 21, with the roller being retracted away from the coin stack during a portion of each revolution to allow a new sheet of wrapping material 30 to be fed into the wrapping mechanism.

The height of the resilient pad 23 is slightly greater than the height of the coin stack 10 to ensure that the last coin at both ends of the stack is secured by the adhesive 31 adjacent the side edges 34 and 35 of the wrapping material. If desired, a small extra length of wrapping material can be folded over the ends of the coin stack, but there is no need for the crimping operation required by present coin wrapping machines, because the coins are retained within the wrapper by the adhesive coating on the wrapping material.

As the trailing edge of the resilient pad 23 clears the coin stack 10, rotation of the coin stack ceases. At this point, the sheet of wrapping material 30 has been wound around the entire circumference of the coin stack 10 and releasably bonded thereto. To eject the wrapped coin roll from the wrapping mechanism, a pair of ejector pins 40 and 41 project laterally from the wrapping roller 21 a short distance behind the trailing edge of the resilient pad 23. As these ejector pins 40 and 41 come into engagement with the wrapped coin roll, they push the coin roll against the spring-loaded exit gate 22, thereby pushing the gate open against its spring bias, through and angle y, and ejecting the wrapped coin roll through the opened gate. At the same time the ejector pins 40 and 41 engage the coin roll, a shoulder 42 on the support disc 20 also engages the wrapped coin roll and assists in ejecting the coin roll from the wrapping mechanism. After the coin roll has cleared the gate 22, the spring load on the gate returns the gate to its closed position.

For the purpose of driving the wrapping roller 21 and the cam 16 and support disc 20 attached to the upper and lower ends thereof, the roller 21 is fastened to a drive shaft 50 journaled in a support plate 51 cantilevered from the bottom of the housing 12. The drive shaft 50 in turn carries a drive pinion 52 which can be driven by any suitable drive means, such as a toothed belt driven by an electric motor. If desired, the drive shaft 50 could be driven directly by an electric motor.

Figure 7:
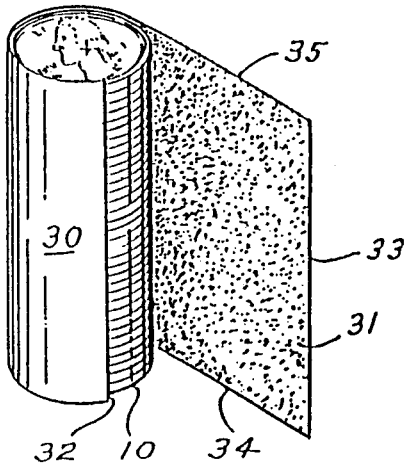
FIG. 7 is a perspective view of a partially wrapped coin roll.
Figure 8:
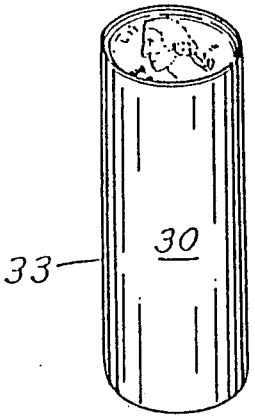
FIG. 8 is a perspective view of a completely wrapped coin roll formed by the mechanism of FIG. 1.

FIG. 7 illustrates a partially wrapped coin roll, with the adhesive-coated inner surface of the leading edge 32 of the wrapping material 30 contacting the coin stack 10 along the lengths of the coin stack and the wrapping material. (The surface of the wrapping material 30 which faces radially toward the coin roll is referred to here as the "inner" surface, while the surface which faces radially away from the coin roll is referred to as the "outer" surface.) In the final wrapped coin roll, shown in FIG. 8, the trailing edge 33 of the adhesive-coated inside surface of the wrapping material 30 overlaps the outside surface of the leading edge 32 and is adhered thereto by the adhesive 31. The adhesive coating along the side edges 34 and 35 of the wrapping material adheres to the coins at the ends of the roll to securely retain those coins in the roll; thus, the adhesive coating proximate the side edges 34 and 35 must contain a coin-supporting amount of the adhesive 31. Because the adhesive 31 is clean-releasing, the coins are selectively held in the wrapper and can be selectively cleanly released from the wrapper by removing the wrapper by merely peeling off the wrapper, whereby the roll of coins is cleanly released.

I claim:

1. A wrapped roll of coins, comprising:

(a) A roll of coins having a length and a circumference; and (b) a wrapper comprising:

(i) a flexible substrate having: a substrate length and a substrate width, the substrate width being greater than the circumference of the roll, and the substrate length being at least as great as the length of the roll; along the length of the substrate an inside edge which contacts the length of the roll and, at the opposite end of the substrate, an outside edge; along the width of the substrate a pair of side edges; an inner surface which faces radially toward the roll; and an outer surface which faces radially away from the roll; and (ii) on the inner surface of the flexible substrate proximate the side edges, a coin-supporting amount of an effective clean-releasing pressure-sensitive adhesive, wherein the adhesive securely retains the coins within the wrapper and the coins can be selectively cleanly released from the wrapper without tearing the wrapper, whereby the wrapper can be reused.

2. A method for selectively holding a roll of coins having a circumference, a length, two ends and two opposite circular sides comprising:

(a) arranging coins to form the roll of coins;

(b) selecting a flexible substrate having: a substrate length and a substrate width, the substrate width being greater than the circumference of the roll, and the substrate length being at least as great as the length of the roll; along the length of the substrate an inside edge which is suitable for contacting the length of the roll and, at the opposite end of the substrate, an outside edge; along the width of the substrate a pair of side edges; an inner surface suitable for contacting the roll of coins; and an outer surface opposite the inner surface, wherein on the inner surface proximate the side edges is a coin-supporting amount of an effective clean-releasing pressure-sensitive adhesive;

(c) contacting the length of the roll with the inside edge of the flexible substrate such that the ends of the coin roll are in contact with the adhesive;

(d) wrapping the roll in the flexible substrate, wherein the inner surface of the flexible substrate is in operable contact with the coins around the circumference of the roll of coins and wherein the ends of coin roll are securely retained by the adhesive; and (e) removing the flexible substrate to unwrap the roll, wherein the roll of coins is cleanly released and wherein the flexible substrate can be reused.

3. A method of wrapping a stack of coins to form a coin roll having a circumference, a length and two ends, said method comprising the steps of arranging a predetermined number of coins to form a coin stack, contacting the coin stack with a wrapping material coated on the side facing the coin stack with a coin-supporting amount of an effective clean-releasing pressure-sensitive adhesive, the coin stack being contacted with the adhesive-coated side of said wrapping material, said wrapping material having a width greater than the circumference of said coin stack and a length at least as great as the length of said coin stack, rotating the coin stack about its axis while pressing said wrapping material against the coin stack so that the adhesive bonds the wrapping material to the coin stack and causes the wrapping material to be wound around the coin stack to form a coin roll, said adhesive being located to engage at least the endmost coins in said stack to securely retain said coin stack within said wrapping material, and subsequently removing said coins from said roll by removing said wrapping material and the adhesive thereon from said coins.

4. The method of claim 3 wherein said wrapping material is pressed against the rotating coin stack by engaging said wrapping material with resilient biasing means urging said wrapping material against said coin stack.

5. The method of claim 4 wherein said coin stack is rotated by movement of said resilient biasing means while said resilient biasing means is urging said wrapping material against said coin stack.

6. The method of claim 3 wherein said adhesive extends along the full length of said coin stack.

* * * * *